US007690898B2

(12) United States Patent
Kume et al.

(10) Patent No.: US 7,690,898 B2
(45) Date of Patent: Apr. 6, 2010

(54) CONTROL VALVE FOR VARIABLE DISPLACEMENT COMPRESSOR

(75) Inventors: Yoskiyuki Kume, Setagaya-ku (JP); Toru Watanuki, Setagaya-ku (JP); Daisuke Morisawa, Setagaya-ku (JP)

(73) Assignee: Fujikoki Corporation, Tokyo (JP)

( * ) Notice: Subject to any disclaimer, the term of this patent is extended or adjusted under 35 U.S.C. 154(b) by 186 days.

(21) Appl. No.: 11/784,344

(22) Filed: Apr. 6, 2007

(65) Prior Publication Data

US 2007/0243076 A1 Oct. 18, 2007

(30) Foreign Application Priority Data

Apr. 13, 2006 (JP) ..... 2006-111055

(51) Int. Cl.
*F04B 1/26* (2006.01)

(52) U.S. Cl. ..... 417/222.2; 251/129.15

(58) Field of Classification Search ..... 417/222.2; 251/129.15; 62/228.3; 335/255, 261
See application file for complete search history.

(56) References Cited

U.S. PATENT DOCUMENTS 5,626,165 A * 5/1997 Shinobu ..... 137/556
6,062,824 A * 5/2000 Kimura et al. ..... 417/222.2
6,561,482 B2 * 5/2003 Okii ..... 251/129.15
6,626,645 B2 * 9/2003 Okii et al. ..... 417/222.2
6,684,654 B2 * 2/2004 Fukasaku et al. ..... 62/228.3
6,769,667 B2 * 8/2004 Kume et al. ..... 251/129.18
6,918,571 B1 * 7/2005 Rose ..... 251/129.18
7,128,304 B2 * 10/2006 Morisawa et al. ..... 251/129.18
2003/0190238 A1 * 10/2003 Takai ..... 417/222.2
2004/0202552 A1 * 10/2004 Okii et al. ..... 417/222.2
2006/0228227 A1 * 10/2006 Mori et al. ..... 417/222.2
2007/0264134 A1 * 11/2007 Hirota ..... 417/222.2

FOREIGN PATENT DOCUMENTS

DE 3938896 A1 * 5/1991
JP 09178027 A * 7/1997
JP 2003-172256 6/2003
JP 2004-100473 4/2004

OTHER PUBLICATIONS

Machine Translation of DE3938896.*

* cited by examiner

*Primary Examiner*—Devon C Kramer
*Assistant Examiner*—Nathan Zollinger
(74) *Attorney, Agent, or Firm*—R. Nell Sudol; Henry D. Coleman; William J Sapone

(57) ABSTRACT

The control valve comprises a valve rod having a valve body part; a valve main body provided with a valve chamber having a valve port to/from which the valve body part contacts/separates, a discharge pressure refrigerant inlet for introducing the refrigerant from a compressor, and a refrigerant outlet communicating with a crank chamber of the compressor; an electromagnetic actuator having a plunger for moving the valve rod in the valve closing direction; a pressure sensing chamber in which suction pressure is introduced from the compressor; and a pressure sensitive response member for pressing the valve rod in the valve opening direction corresponding to the pressure in the pressure sensing chamber, wherein the valve rod is fitted to the plunger having a predetermined diametrical directional clearance so as not to be influenced from the lateral deviation and inclination of the plunger.

14 Claims, 6 Drawing Sheets

CONTROL VALVE FOR VARIABLE DISPLACEMENT COMPRESSOR

BACKGROUND OF THE INVENTION

1. Field of the Invention

The present invention relates to a control valve for a variable displacement compressor used for a car air-conditioner and the like, and more particularly, to a control valve for a variable displacement compressor capable of hardly causing operation failure of a valve rod.

2. Description of the Conventional Art

Generally in a conventional control valve for a variable displacement compressor used for a car air-conditioner and the like, refrigerant having discharge pressure Pd is introduced from a compressor (a discharge chamber of a compressor) and is throttled so as to be introduced to a crank chamber, in order to adjust a pressure Pc in the crank chamber of the compressor. An introducing amount (a throttling amount) into the crank chamber is controlled corresponding to a suction pressure Ps of the compressor. As for the basic constitution of the control valve, as described in Japanese Patent Application Laid Open No. 2003-172256 for example, the control valve for a variable displacement compressor includes a valve rod having a valve body part; a valve main body which has a guiding hole in which the valve rod is slidably inserted, a valve chamber having a valve port to/from which the valve body part contacts/separates, a discharge pressure refrigerant inlet provided at an upstream side than the valve port for introducing refrigerant having discharge pressure from the compressor and a refrigerant outlet provided at the downstream side than the valve port so as to communicate with a crank chamber of the compressor; an electromagnetic actuator having a coil, a cylindrical stator arranged at the inner periphery side of the coil, an attraction piece fixed to the stator, a plunger arranged at the lower side than the attraction piece so as to be upwardly and downwardly slidable, a plunger spring arranged between the attraction piece and the plunger, and a guiding pipe in which the plunger is slidably inserted; a pressure sensing chamber formed at the upper side than the attraction piece, into which a suction pressure is introduced from the compressor; a pressure sensitive response member for pressing the valve rod in the valve opening direction corresponding to a pressure of the pressure sensing chamber; and a valve closing spring for energizing the valve rod in a valve closing direction.

In the conventional control valve having such the constitution, when the electric current is applied to the coil of the electromagnetic actuator, the plunger is attracted to the attraction piece. Then, the valve rod is moved in the valve closing direction following the plunger by energizing force of the valve closing spring. On the other hand, refrigerant having a suction pressure Ps introduced from a compressor to a suction pressure introducing inlet is introduced into the pressure sensing chamber from an introduction chamber through a clearance formed between the plunger and a guiding pipe arranged on the outer periphery of the plunger. The pressure sensitive response member (for example, a bellows device) is displaced so as to extend or contract corresponding to the pressure (the suction pressure Ps) in the pressure sensing chamber (the member contracts when the suction pressure Ps is high, and extends when the suction pressure Ps is low). The displacement (pressing force) is transmitted to the valve rod, so as to control a valve opening. The valve opening is determined by the attracting force of the attraction piece to the plunger, the pressing force of the pressure sensitive response member, and the energizing forces of a plunger spring (a valve opening spring) and a valve closing spring. Corresponding to the valve opening, the introducing amount (the throttling amount) into the outlet side, that is, into the crank chamber, of the refrigerant having a discharge pressure introduced into the valve chamber from the discharge pressure refrigerant inlet, is adjusted, so as to control the pressure Pc in the crank chamber.

However, the above-described control valve has the constitution in which the valve rod moves in the valve closing direction by only the energizing force of the valve closing spring. So, the operation failure of locking of the valve rod or the like is caused when a foreign matter is clogged between sliding faces of the valve rod and the guiding hole or the sliding resistance of the valve rod is increased by oil seizing or the like. For example, there is a problem that even when the plunger is attracted by the attraction piece, the valve rod does not move in the valve closing direction so as to be inactive. In such case, the valve opening is not properly controlled. In order to solve such the operation failure, the energizing force of the valve closing spring may be increased. However, if the energizing force is increased, the energizing force of the plunger spring (the valve opening spring) must be also increased. As a result of this, the sizes of springs and a product are increased, so that the cost is increased.

So, in order to solve the problems, Japanese Patent Application Laid Open No. 2004-100473 proposes a control valve, in which a plunger and a valve rod are directly connected (integrated), so as to forcedly move the valve rod in the valve closing direction together with the plunger when the plunger is attracted by a attraction piece.

However, the above-described control valve in which the plunger and the valve rod are directly connected has the following problems.

When electric current is applied, the plunger may move upwardly and downwardly (in the valve opening and closing directions) while being laterally deviated (moved to one side) or inclined depending on a magnetic circuit (due to the concentricity of the attraction piece and the plunger). Thereby, if the plunger and the valve rod are connected without a backlash, the valve rod is pushed to the guiding hole according to the deviation or inclination of the plunger so as to increase sliding resistance. As a result, the valve rod and the plunger do not smoothly move, so as to cause operation failure such as locking, which is similar to the above-described problem.

Further, when the plunger and the valve rod are directly connected, the size management and assembling accuracy of parts are hardly achieved due to the above-described problem, and the cost may be increased.

SUMMARY OF THE INVENTION

The present invention is made to solve the above-described problems, an objective of the present invention is to provide a control valve for a variable displacement compressor capable of hardly causing operation failure of a valve rod without increasing the cost and size.

In order to realize the above-described objective, a control valve for a variable displacement compressor according to the present invention basically comprises a valve rod having a valve body part; a valve main body including a guiding hole in which the valve rod is slidably and fitly inserted, a valve chamber having a valve port to/from which the valve body part contacts/separates, a discharge pressure refrigerant inlet provided at the upstream side than the valve port for introducing refrigerant having discharge pressure from a compressor, and a refrigerant outlet provided at the downstream side than the valve port so as to communicate with a crank chamber of the compressor; an electromagnetic actuator having a plunger for moving the valve rod in the valve closing direction; a pressure sensing chamber in which a suction pressure is introduced from the compressor; and a pressure sensitive response member for pressing the valve rod in the valve opening direction corresponding to the pressure of the pressure sensing chamber, wherein, although the valve rod is forcedly moved in the valve closing direction by the plunger, the valve rod is fitted to the plunger having a predetermined diametrical directional clearance so as not to be influenced by lateral deviation and inclination of the plunger.

As for a more preferable aspect of the control valve, a control valve comprises a valve rod having a valve body part; a valve main body including a guiding hole in which the valve rod is slidably and fitly inserted, a valve chamber having a valve port to/from which the valve body part contacts/separates, a discharge pressure refrigerant inlet provided at the upstream side than the valve port for introducing refrigerant having discharge pressure from a compressor, and a refrigerant outlet provided at the downstream side than the valve port so as to communicate with a crank chamber of the compressor; an electromagnetic actuator having a coil, a cylindrical stator arranged at the inner periphery side of the coil, an attraction piece fixed to the stator, a plunger arranged at the lower side than the attraction piece so as to be upwardly and downwardly slidable, a plunger spring arranged between the attraction piece and the plunger, and a guiding pipe in which the plunger is slidably and fitly inserted; a pressure sensing chamber formed at the upper side than the attraction piece, in which a suction pressure is introduced from the compressor; and a pressure sensitive response member for pressing the valve rod in the valve opening direction corresponding to the pressure of the pressure sensing chamber, wherein, although the valve rod is forcedly moved in the valve closing direction by the plunger when the plunger is attracted by the attraction piece, the valve rod is fitted to the plunger having a predetermined diametrical directional clearance so as not to be influenced by lateral deviation and inclination of the plunger.

In a preferable aspect, the plunger has an inserting hole in which an upper part of the valve rod is fitly inserted, and a locking part for forcedly moving is provided at the upper side than the inserting hole of the valve rod. Further, a clearance formed between the valve rod and the inserting hole is made larger than a clearance formed between the plunger and the guiding pipe arranged around the outer periphery of the plunger.

In this case, the locking part for forcedly moving is preferably formed with an annular member, which is externally fitted to the valve rod to be caulked and fixed.

As for another preferable aspect, a small diameter part is provided at the valve rod, a large diameter part as the locking part for forcedly moving is provided at the upper side of the small diameter part, and a center hole in which the small diameter part is fitly inserted is provided at the center of the plunger. In order to easily assemble these parts, an eccentric hole capable of inserting the large diameter part is provided so as to have an eccentricity of a predetermined distance in the diametrical direction and to partially overlap with the center hole. The clearance formed between the small diameter part and the center hole is made larger than the clearance formed between the plunger and the guiding pipe arranged around the outer periphery of the plunger.

As for another preferable aspect, the valve rod is divided into an upper part and a lower part, where the upper part is from an upper end part contacting to the pressure sensitive response member to the upper side of the locking part for forcedly moving, and the lower part is the lower side than the upper part. A lower end face of the upper part oppositely contacts to an upper end face of the lower part.

In the control valve for a variable displacement compressor according to the present invention, for example, the plunger has the inserting hole for fitly inserting an intermediate part of the valve rod, and the locking part for forcedly moving is provided at the upper side than the inserting hole in the valve rod. Further, the clearance formed between the valve rod and the inserting hole is made larger than the clearance formed between the plunger and the guiding pipe arranged around the outer periphery of the plunger. Then, although the valve rod is forcedly moved in the valve closing direction by the plunger, the valve rod is fitted to the plunger having a predetermined diametrical directional clearance so as not to be influenced from the lateral deviation and inclination of the plunger. So, even when the plunger is laterally deviated or inclined, the valve rod is not pushed to the guiding hole. Therefore, the sliding resistance of the valve rod is not increased and, as a result of this, the operation failure of the valve rod is hardly caused.

Further, the size management and assembling accuracy of parts may be carried out not so rigidly (those may be carried out like a conventional control valve in which a plunger and a valve rod are not directly connected). In addition, since it is not necessary to increase the size of a valve closing spring, the cost increase can be restricted to the minimum.

BRIEF EXPLANATION OF DRAWINGS

FIG. 2A is an enlarged longitudinal cross sectional view, and FIG. 2B is a cross sectional view taken along the arrow B-B in FIG. 2A.

FIG. 4A is an enlarged plane view, and FIG. 4B is an enlarged cutout perspective view.

DETAILED DESCRIPTION OF PREFERRED EMBODIMENTS

Figure 1:
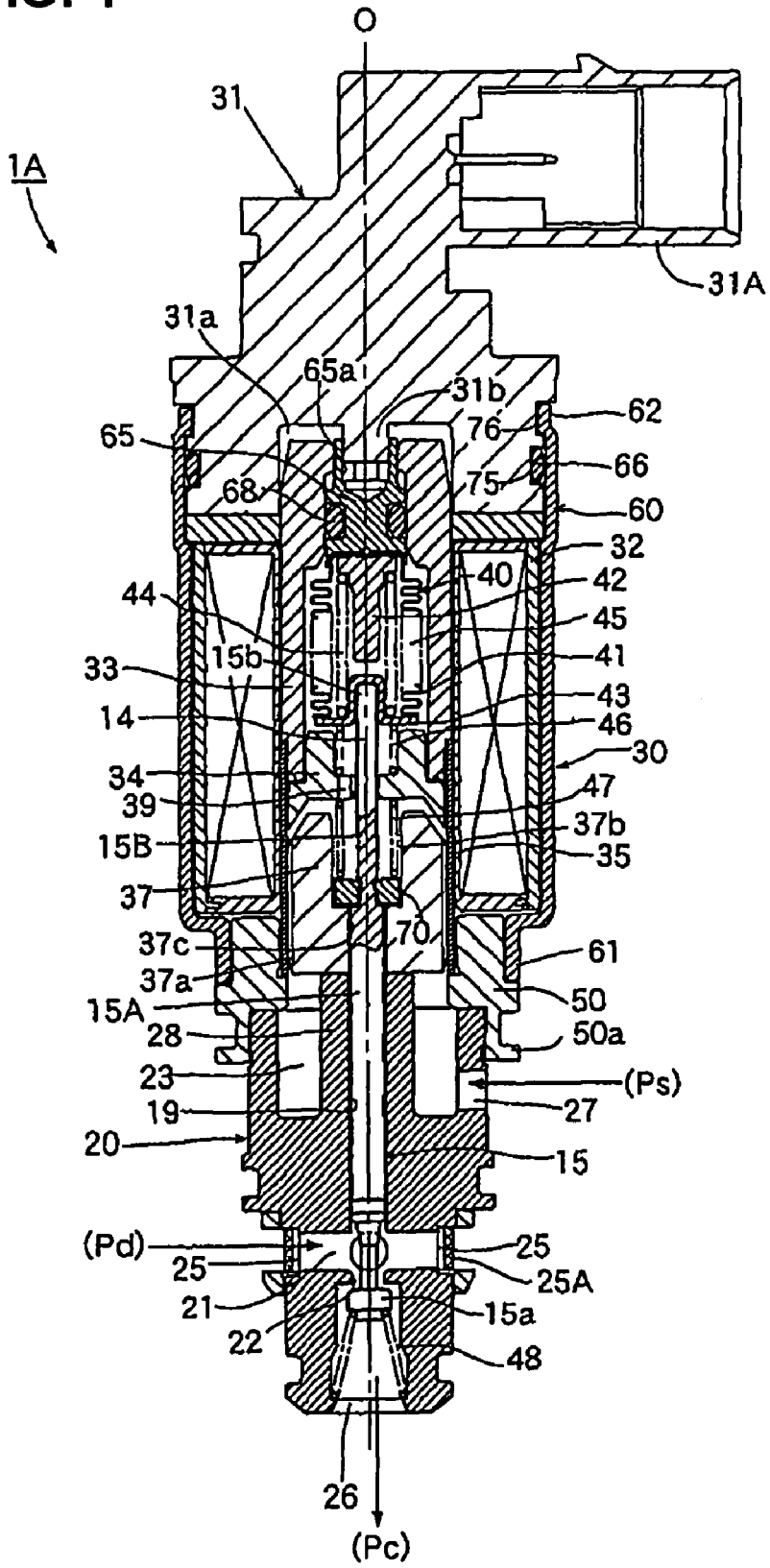
FIG. 1 is a longitudinal cross sectional view for illustrating a first embodiment of a control valve for a variable displacement compressor according to the present invention.

Hereinafter, embodiments of a control valve for a variable displacement compressor of the present invention will be described with drawings. FIG. 1 is a longitudinal cross sectional view for illustrating the first embodiment of a control valve for a variable displacement compressor according to the present invention.

In FIG. 1, a control valve 1A includes a valve rod 15 having a valve body part 15*a*, and a valve main body 20. The valve main body 20 includes a valve chamber 21 having a valve seat (a valve port) 22 to/from which the valve body part 15*a* contacts/separates, a discharge pressure refrigerant introducing inlet 25 with a plurality of filters 25A provided at an outer periphery side of the valve chamber 21 (at the upstream side than the valve seat 22) for introducing a refrigerant having a discharge pressure Pd from a compressor, and a refrigerant outlet 26 provided at a lower part (at the downstream side) of the valve seat 22 so as to communicate with a crank chamber of the compressor. Further, the control valve 1A also includes an electromagnetic actuator 30.

The electromagnetic actuator 30 comprises a coil 32 for exciting by electric current, a connector head 31 having a power source connector part 31A mounted on the upper side of the coil 32, a cylindrical stator 33 arranged at the inner periphery side of the coil 32, an attraction piece 34 having a recess shaped cross section which is pressed-in and fixed at the inner periphery of a lower end part of the stator 33, a guiding pipe 35 having a flange shaped part, of which a top end part is connected with the outer periphery of the lower end part (a stepped part) of the stator 33 by TIG welding, a plunger 37 which is arranged at a lower side than the attraction piece 34 and at the inner periphery side of the guiding pipe 35 so as to be upwardly and downwardly slidable, and a cylindrical stepped housing 60 which is externally fitted on the coil 32 and the connector head 31.

An annular groove for sealing 75 is formed at the outer periphery part of the connector head 31, and an O-ring 66 as a sealing member is mounted in the annular groove for sealing 75 while being compressed toward the inner side in the radial direction by the housing 60.

Further, an annular groove for caulking 76 is formed at the upper side than the annular groove for sealing 75 in the outer periphery part of the connector head 31, and an upper end part (a caulked part) of the housing 60 is pushed into the annular groove for caulking 76 to be caulked and fixed.

An adjust screw 65 having a hexagonal hole is screwed to an upper part of the stator 33, and a pressure sensing chamber 45, in which suction pressure Ps of a compressor is introduced, is formed between the adjust screw 65 and the attraction piece 34 at the inner periphery side of the stator 33. The pressure sensing chamber 45 has a bellows main body 40, as a pressure sensitive response member, including a bellows 41, an downwardly-projected upper stopper 42, an upwardly-recessed lower stopper 43, and a compression coil spring 44. Further, a compression coil spring 46 for energizing in the direction of contracting the bellows main body 40 (the direction of contracting toward the adjust screw 65 side) is arranged between the bellows main body 40 and the attraction piece 34. Furthermore, an upper end part 15*b* of the valve rod 15 is inserted into (the upwardly recessed part of) the lower stopper 43 of the bellows main body 40 so as to contact thereto, and a plunger spring (a valve opening spring) 47 including a compression coil spring for energizing the valve rod 15 in the lower direction (the valve opening direction) is arranged between the attraction piece 34 and a recessed part 37*b* (a locking part for forcedly moving 70 arranged therein) of the plunger 37.

On the other hand, the valve main body 20 has a projected stopper part 28 at the center of an upper part thereof for controlling the lowermost descending position of the plunger 37, and an guiding hole 19, in which the valve rod 15 is slidably and fitly inserted, is formed at a center portion of an upper side than the valve chamber including the projected stopper part 28. Further, a suction pressure refrigerant introducing chamber 23, in which refrigerant having suction pressure of a compressor is introduced, is formed between the plunger 37 and the outer periphery of an upper part of the valve main body 20 (the outer periphery of the projected stopper part 28), and a plurality of suction pressure refrigerant introducing inlets 27 is formed at the outer periphery side of the chamber 23. The refrigerant having suction pressure Ps introduced from the suction pressure refrigerant introducing inlets 27 into the suction pressure refrigerant introducing chamber 23 is introduced into the pressure sensing chamber 45 through vertical grooves 37*a* and 37*a* (refer to FIGS. 2A and 2B) formed on the outer periphery of the plunger 37, and a communication hole 39 formed at the attraction piece 34.

The valve main body 20 has a valve closing spring 48 at a lower part (the refrigerant outlet 26) thereof, where the valve closing spring 48 is constituted of a conical compression coil spring for upwardly energizing the valve rod 15.

Further, a lower end part of the pipe 35 is internally fitted to the inner periphery of a holder 50, and is connected and fixed by brazing. Further, a lower part small diameter part 61 of the housing 60 is press-fitted on the outer periphery of the holder 50, and a lower part of the holder 50 has a cylindrical part with a thin flange 50*a*, which is externally fitted to an upper part outer periphery of the valve main body 20. By subjecting the cylindrical part with a thin flange 50*a* to peel caulking processing, the holder 50 is fixed to the valve main body 20.

In addition to the above-described constitution, in this embodiment, when the plunger 37 is attracted by the attraction piece 34 (when electric current is applied), the valve rod 15 is forcedly pulled in the closing direction by the plunger 37. However, the valve rod 15 is not influenced from lateral deviation or inclination of the plunger 37.

Figure 2A:
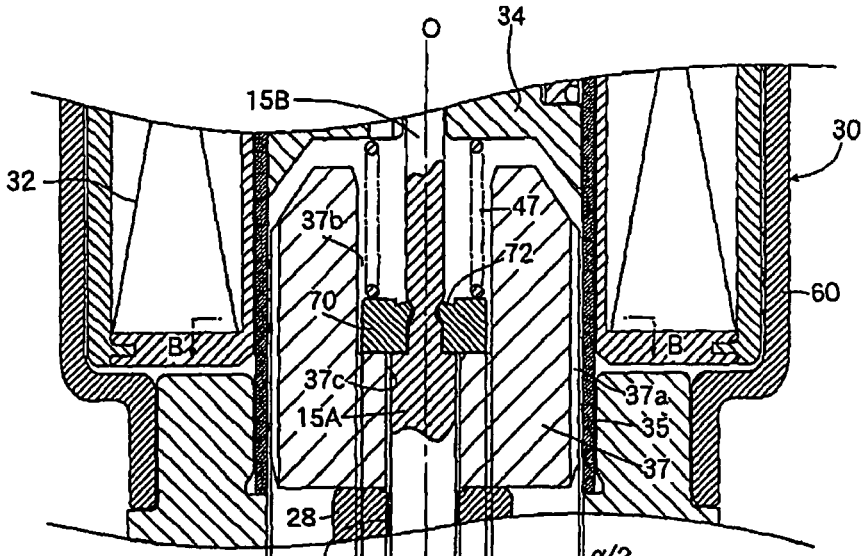
FIGS. 2A and 2B are views for illustrating a plunger in FIG. 1 and its vicinity, where
Figure 2B:
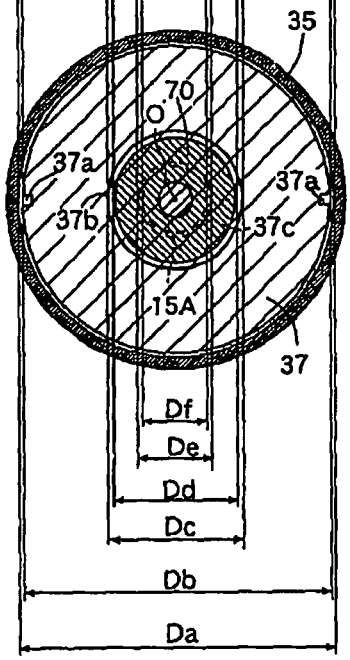

More particularly, as illustrated in FIGS. 2A and 2B, the plunger 37 has an inserting hole 37*c*, in which a lower large diameter part 15A of the valve rod 15 is fitly inserted, in addition to the recessed part 37*b*. Further, the plunger 37 also has a locking part for forcedly moving 70 at the upper side than the inserting hole 37*c* in the valve rod 15, where the locking part 70 has a larger outer diameter than the diameter of the inserting hole 37*c*. The locking part for forcedly moving 70 is constituted of an annular member which is externally fitted to the small diameter upper part 15B of the valve rod 15, and caulked fixedly (a caulked part 72).

Further, a clearance β (the maximum clearance) formed between the locking part for forcedly moving 70 and the inner periphery face of the recessed part 37*b* of the plunger 37, and a clearance γ (the maximum clearance) formed between the valve rod 15 (the lower large diameter part 15A) and the inserting hole 37*c* are made larger than a clearance α (the maximum clearance) formed between the plunger 37 and the guiding pipe 35 arranged around the outer periphery of the plunger 37.

In this case, α, β and γ are as follows.

α: (Inner diameter Da of the guiding pipe 35)—(Outer diameter Db of the plunger 37)=about 20 μm β: (Inner diameter Dc of the recessed part 37*b*)—(Outer diameter Dd of the locking part for forcedly moving 70)=about 40 μm γ: (Inner diameter De of the inserting hole 37*c*)—(Outer diameter Df of the lower large diameter part 15A of the valve rod)=about 40 μm In addition, the clearance formed between the lower large diameter part 15A of the valve rod 15 and the guiding hole 19 is made fairly smaller (about 10 μm) than the clearances α, β and γ, in order to suppress leaking of a refrigerant from the valve chamber 21 to the suction pressure refrigerant introduction chamber 23 as much as possible.

In the control valve 1A having the above-described constitution, when the plunger 37 is attracted by the attraction piece 34 (when electric current is applied), the valve rod 15 is pushed up in the valve closing direction by the energizing force of the valve closing spring 48, and the locking part for forcedly moving 70 is locked to the plunger 37. So, the valve rod 15 is forcedly pulled in the valve closing direction by the plunger 37. On the other hand, the refrigerant having the suction pressure Ps introduced into the suction pressure introducing inlet 27 from the compressor is introduced into the pressure sensing chamber 45 from the introducing chamber 23 through the vertical grooves 37*a*, 37*a*, . . . formed on the outer periphery of the plunger 37 and the communication hole 39 formed at the attraction piece 34. The bellows main body 40 (the inside of which has a vacuum pressure) is displaced by extending or contracting corresponding to the pressure (the suction pressure Ps) in the pressure sensing chamber 45 (where the bellows main body 40 contracts when the suction pressure Ps is high, and extends when the suction pressure Ps is low), and the displacement is transmitted to the valve rod 15 so as to control a valve opening. That is, the valve opening is determined by the attracting force of the attraction piece 34 to the plunger 37, the pressing force of the bellows main body 40, and the energizing forces of the plunger spring (the valve opening spring) 47 and the valve closing spring 48. Corresponding to the valve opening, the introducing amount (the throttling amount) of the refrigerant having the discharge pressure Pd, which is introduced into the valve chamber 21 from the discharge pressure refrigerant introducing inlet 25, into the outlet 26 side, that is, into the crank chamber is adjusted so as to control the pressure Pc in the crank chamber.

Further, in this embodiment, the inserting hole 37*c*, in which the lower large diameter part 15A of the valve rod 15 is inserted fitly, is provided in the plunger 37, and the locking part for forcedly moving 70 is provided on the valve rod 15 at the upper side than the inserting hole 37*c*. Further, the clearance β (the maximum clearance) formed between the locking part for forcedly moving 70 and the inner periphery face of the recessed part 37*b* of the plunger 37, and the clearance γ (the maximum clearance) formed between the valve rod 15 (the lower large diameter part 15A) and the inserting hole 37*c* are made larger than the clearance a (the maximum clearance) formed between the plunger 37 and the guiding pipe 35 arranged around the outer periphery of the plunger 37. Thereby, although the valve rod 15 is forcedly moved in the valve closing direction by the plunger 37, the valve rod 15 is not influenced from the lateral deviation and inclination of the plunger 37. So, even when the plunger 37 is laterally deviated or inclined, the valve rod 15 is not pushed to the guiding hole 19. Therefore, the sliding resistance of the valve rod 15 is not increased and, as a result of this, the operation failure of the valve rod 15 is hardly caused.

Further, the size management and assembling accuracy of parts may be carried out not so rigidly (those may be carried out like a conventional control valve in which a plunger and a valve rod are not directly connected). In addition, since it is not necessary to increase the size of a valve closing spring, the cost increase can be restricted to the minimum.

Figure 3:
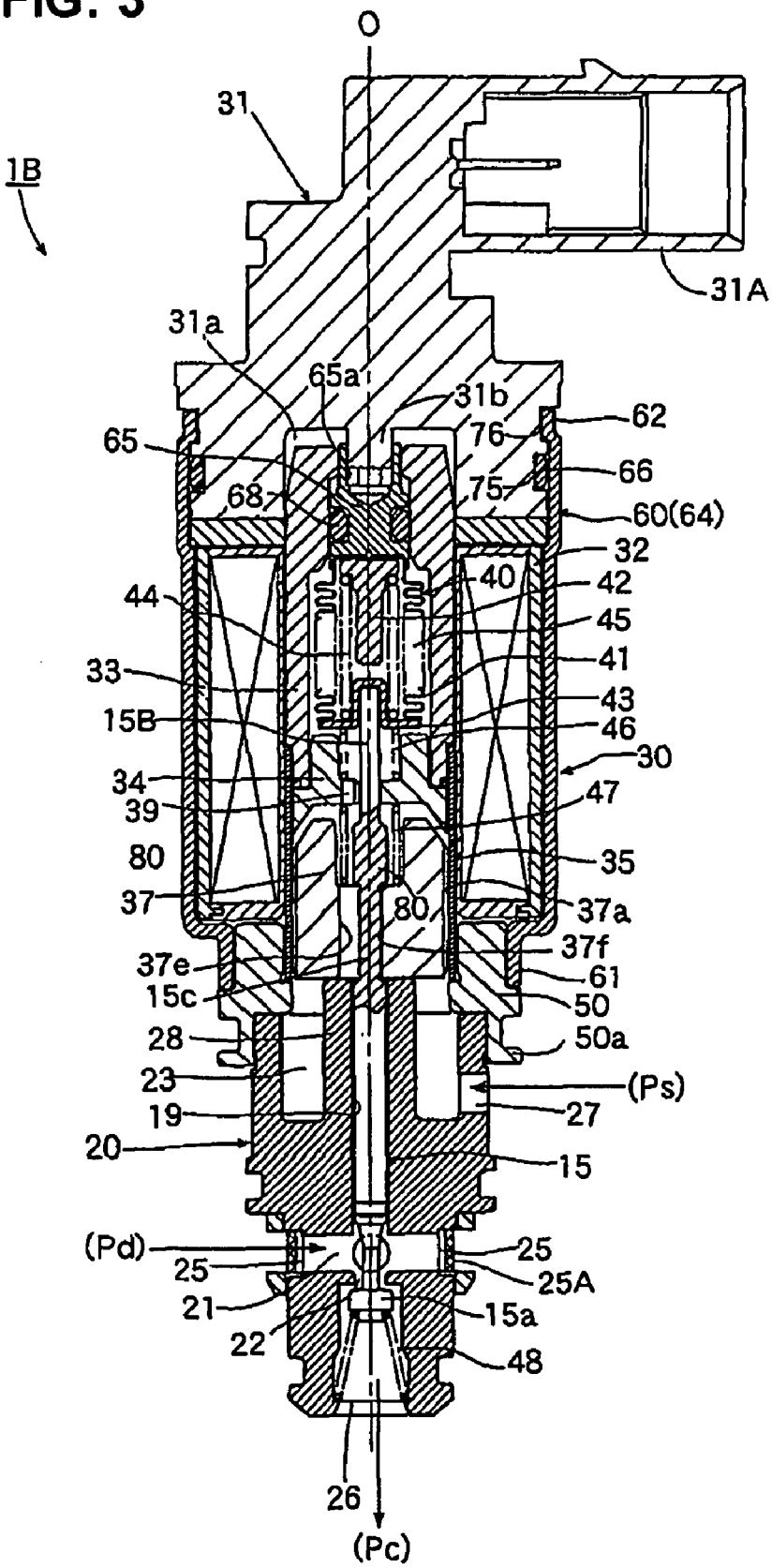
FIG. 3 is a longitudinal cross sectional view for illustrating a second embodiment of a control valve for a variable displacement compressor according to the present invention.

FIG. 3 is a longitudinal cross sectional view for illustrating the second embodiment of a control valve for a variable displacement compressor according to the present invention.

In a control valve 1B of the second embodiment in FIGS. 2A and 2B, the same reference numerals are given to the similar constitution and function parts to those of the control valve 1A of the above-described first embodiment and the descriptions are omitted. The different parts will be mainly described hereinafter.

Figure 4A:
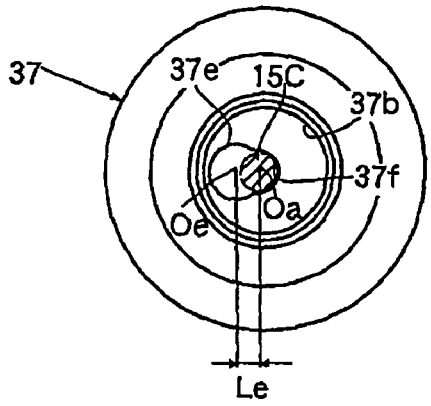
FIGS. 4A and 4B are views for illustrating a plunger in FIG. 3, where
Figure 4B:
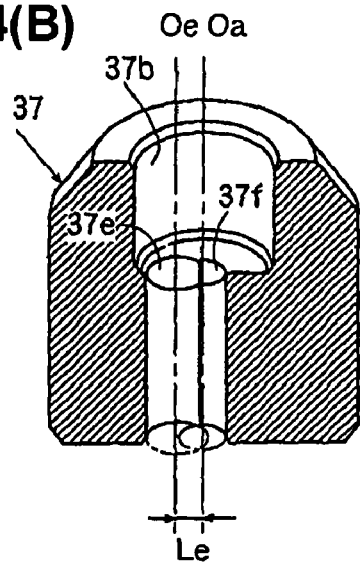

In the control valve 1B of the second embodiment, an intermediate small diameter part 15C is provided at the valve rod 15, and a large diameter part 80 to be the locking part for forcedly moving is provided at the upper side of the small diameter part 15*c*. On the other hand, as illustrated in FIG. 4, a small diameter center hole 37*f* (a center line Oa), in which the small diameter part 15C is fitly inserted, is provided at the center of the plunger 37. Further, in order to easily assemble these parts, a large diameter eccentric hole 37*e* (a center line Oe) capable of inserting the large diameter part (the locking part for forcedly moving) 80 is provided so as to have an eccentricity of a predetermined distance Le in the diametrical direction and to partially overlap with the small diameter center hole 37*f*, while being longitudinally or axially coextensive with the center hole 37*f*. In this case, the diameters of the center hole 37*f* and the eccentric hole 37*e*, and the center distance Le between those, are set so as not to detach the plunger 37 from the valve rod 15 even when the plunger 37 is laterally deviated or inclined.

Further, the clearance (the maximum clearance) formed between the valve rod 15 (the intermediate small diameter part 15*c* thereof) and the small diameter center hole 37*f* is made larger than the clearance (the maximum clearance) formed between the plunger 37 and the guiding pipe 35 arranged around the outer periphery of the plunger 37, like the first embodiment.

Figure 5A:
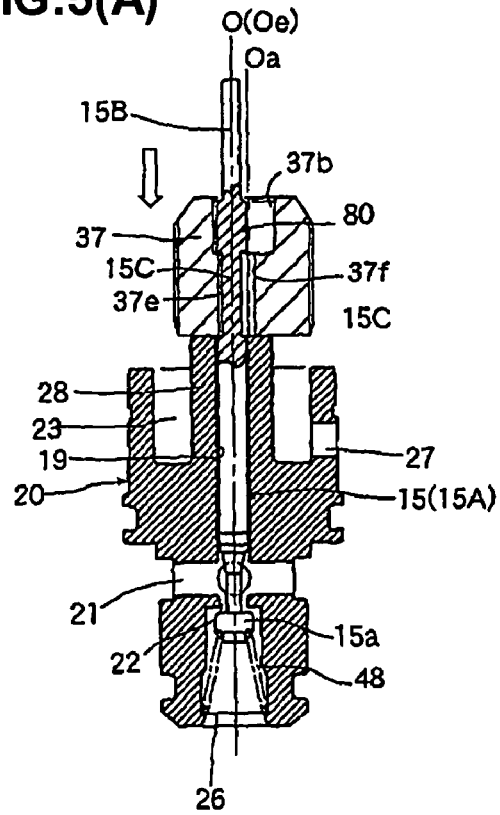
FIG. 5 is a view for explaining an assembling processing of a control valve illustrated in FIG. 3.
Figure 5B:
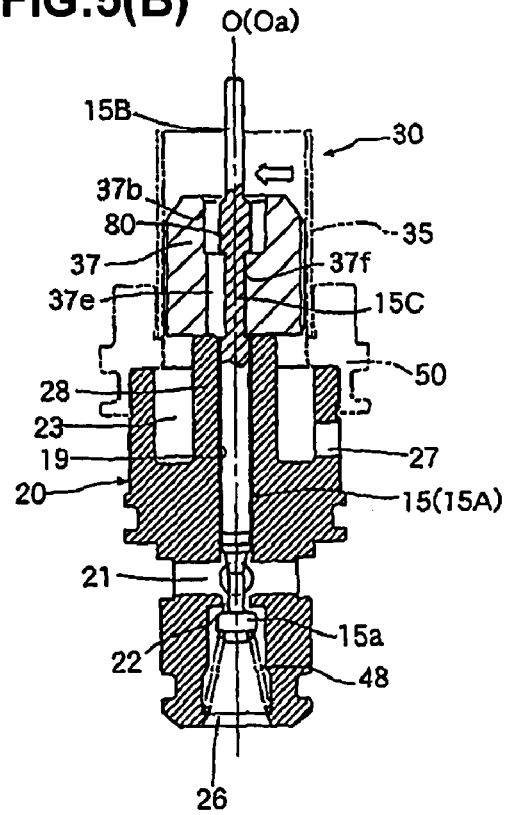

Further, when the plunger 37 is assembled with the other parts, the plunger 37 is dropped along the valve rod 15 so as to pass the large diameter part (the locking part for forcedly moving) 80 through the eccentric hole 37*e*, as illustrated in FIG. 5A. Then, the plunger 37 is laterally moved so as to fitly insert the intermediate small diameter part 15C into the small diameter center hole 37*f*, as illustrated in FIG. 5B. Then, the guiding pipe 35 and the like are mounted.

In the control valve 1B of this embodiment having such the constitution, the approximately similar operation effect to that of the first embodiment can be obtained. Further, since the caulking processing or the like in the first embodiment is not necessary, the cost for assembling the parts can be restricted.

Figure 6:
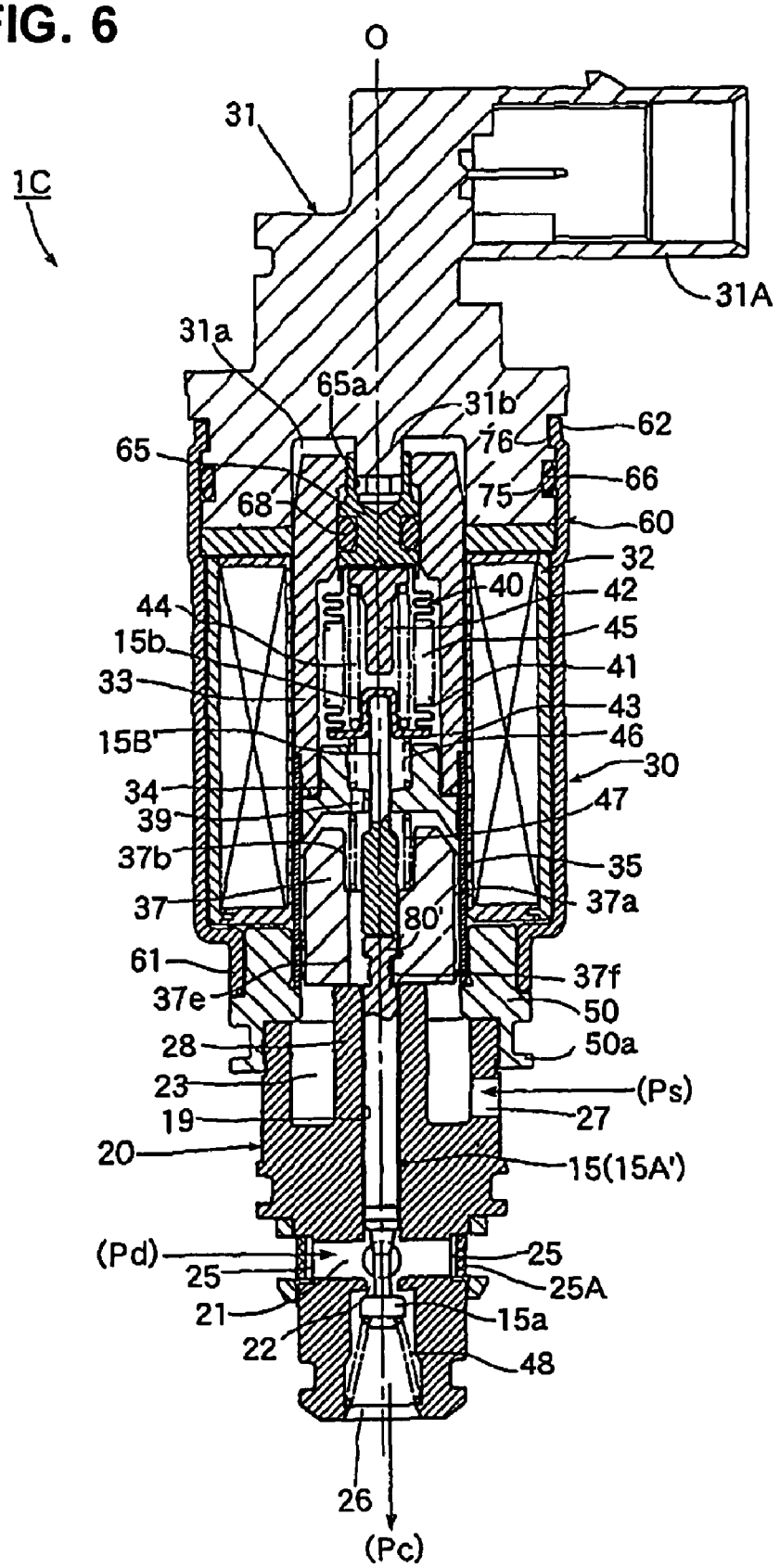
FIG. 6 is a longitudinal cross sectional view for illustrating a third embodiment of a control valve for a variable displacement compressor according to the present invention.

FIG. 6 is a longitudinal cross sectional view for illustrating the third embodiment of a control valve for a variable displacement compressor according to the present invention.

In a control valve 1C of the third embodiment in FIG. 6, the same reference numerals are given to the similar constitution and function parts to those of the control valve 1B of the above-described second embodiment and the descriptions are omitted. The different parts will be mainly described hereinafter.

In the control valve 1C of the third embodiment, a large diameter part (a locking part for forcedly moving) 80' is made shorter than that of the second embodiment, and is placed at a little lower position than that of the second embodiment. A valve rod 15 is divided into an upper part 15B' and a lower part 15A', where the upper part 15B' is from an upper end part 15*b* (which is inserted and contacted to the lower stopper 43 of the bellows main body 40) to the upper side of the large diameter part (the locking part for forcedly moving) 80', and the lower part 15A' is the lower side than the upper part 15B'. A lower end face of the upper part 15B' oppositely contacts to an upper end face of the lower part 15A'.

By having such the constitution, even when a bellows main body 40 undesirably operates such as laterally deviating or inclining, for example, the lower part 15A' (the valve body part 15*a*) of the valve rod 15 is not influenced from such operation.

Figure 7:
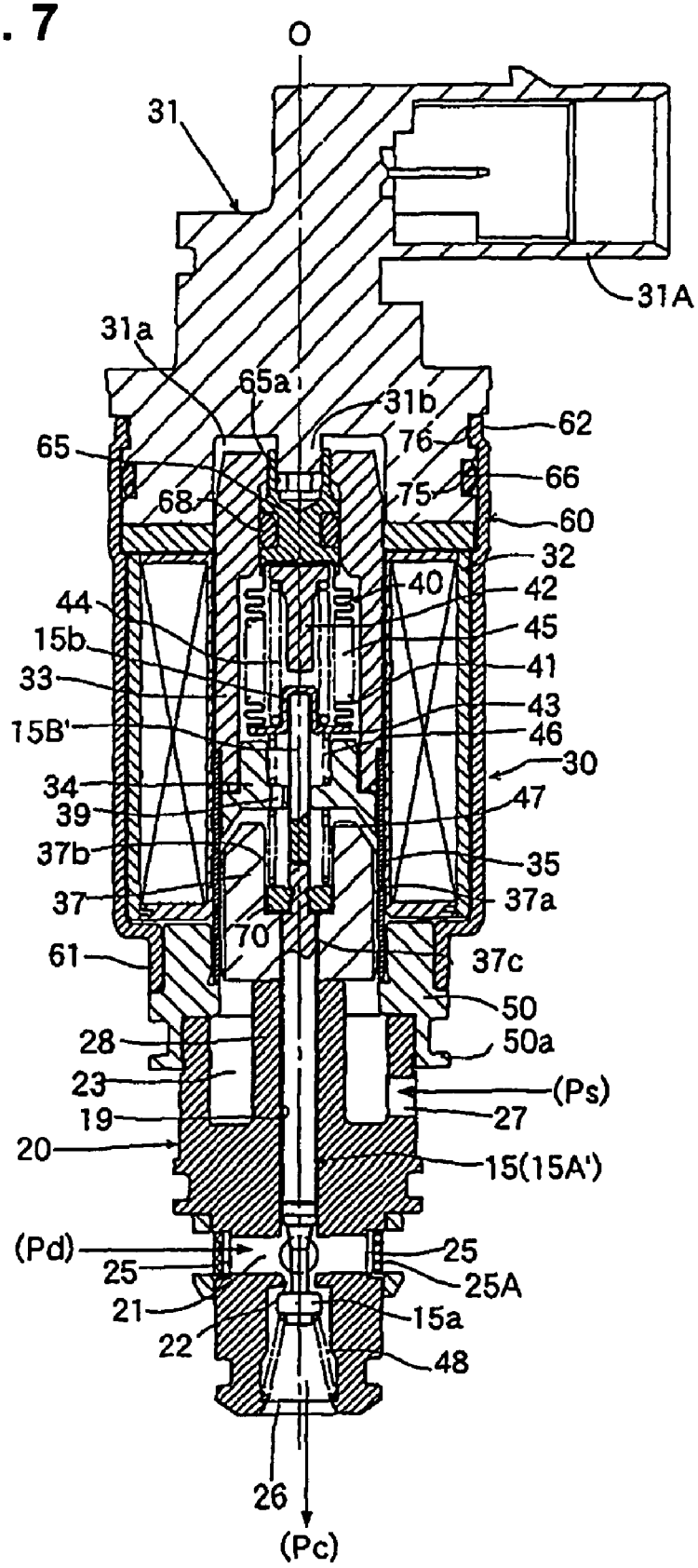
FIG. 7 is a longitudinal cross sectional view for illustrating a fourth embodiment of a control valve for a variable displacement compressor according to the present invention.

FIG. 7 is a longitudinal cross sectional view for illustrating the fourth embodiment of a control valve for a variable displacement compressor according to the present invention.

In a control valve 1D of the fourth embodiment in FIG. 7, the same reference numerals are given to the similar constitution and function parts to those of the control valve 1A of the above-described first embodiment and the descriptions are omitted. The different parts will be mainly described hereinafter.

In a control valve 1D in the fourth embodiment, a valve rod 15 is divided into an upper part 15B' and a lower part 15A', where the upper part 15B' is from an upper end part 15*b* to the upper side of a locking part for forcedly moving 70 and the lower part 15A' is the lower side than the upper part 15B'. A lower end face of the upper part 15B' oppositely contacts to an upper end face of the lower part 15A'.

By having such the constitution, even when a bellows main body 40 undesirably operates such as laterally deviating or inclining, for example, the lower part 15A' (the valve body part 15*a*) of the valve rod 15 is not influenced from such operation.

What is claimed is:

1. A control valve for a variable displacement compressor comprising:

a valve rod having a valve body part;

a valve main body including a guiding hole in which the valve rod is slidably and fitly inserted, a valve chamber having a valve port to/from which the valve body part contacts/separates, a discharge pressure refrigerant inlet provided at the upstream side of the valve port for introducing refrigerant having discharge pressure from a compressor, and a refrigerant outlet provided at the downstream side of the valve port so as to communicate with a crank chamber of the compressor;

an electromagnetic actuator having a plunger for moving the valve rod in the valve closing direction;

a pressure sensing chamber in which a suction pressure is introduced from the compressor; and a pressure sensitive response member for pressing the valve rod in the valve opening direction corresponding to the pressure of the pressure sensing chamber, wherein, although the valve rod is forcedly moved in the valve closing direction by the plunger, the valve rod is fitted to the plunger having a predetermined diametrical directional clearance all around said valve rod so as not to be influenced by lateral deviation and inclination of the plunger in any transverse or lateral direction, the valve rod being formed with a small diameter part;

the valve rod being formed on an upper side of the small diameter part with a large diameter part serving as the locking part for forcedly moving;

a center hole in which the small diameter part is fitly inserted being provided at a center of the plunger, the center hole having a center line;

an eccentric hole capable of receiving the large diameter part being provided in the plunger so as to have an eccentricity of a predetermined distance in the diametrical direction and to partially overlap with the center hole in order to facilitate assembly, the eccentric hole having a center line spaced in the diametrical direction from the center line of the center hole; and a clearance formed between the small diameter part and the center hole being larger than a clearance formed between the plunger and a guiding pipe arranged around an outer periphery of the plunger.

2. A control valve for a variable displacement compressor comprising:

a valve rod having a valve body part;

a valve main body including a guiding hole in which the valve rod is slidably and fitly inserted, a valve chamber having a valve port to/from which the valve body part contacts/separates, a discharge pressure refrigerant inlet provided at the upstream side of the valve port for introducing refrigerant having discharge pressure from a compressor, and a refrigerant outlet provided at the downstream side of the valve port so as to communicate with a crank chamber of the compressor;

an electromagnetic actuator having a coil, a cylindrical stator arranged at the inner periphery side of the coil, an attraction piece fixed to the stator, a plunger arranged at the lower side of the attraction piece so as to be upwardly and downwardly slidable, a plunger spring arranged between the attraction piece and the plunger, and a guiding pipe in which the plunger is slidably and fitly inserted;

a pressure sensing chamber formed at the upper side of the attraction piece, in which a suction pressure is introduced from the compressor; and a pressure sensitive response member for pressing the valve rod in the valve opening direction corresponding to the pressure of the pressure sensing chamber, wherein, although the valve rod is forcedly pulled in the valve closing direction by the plunger when the plunger is attracted by the attraction piece, the valve rod is fitted to the plunger having a predetermined diametrical directional clearance all around said valve rod so as not to be influenced by lateral deviation and inclination of the plunger in any transverse or lateral direction, the valve rod being formed with a small diameter part;

the valve rod being formed on an upper side of the small diameter part with a large diameter part serving as the locking part for forcedly moving;

a center hole in which the small diameter part is fitly inserted being provided at a center of the plunger, the center hole having a center line;

an eccentric hole capable of receiving the large diameter part being provided in the plunger so as to have an eccentricity of a predetermined distance in the diametrical direction and to partially overlap with the center hole in order to facilitate assembly, the eccentric hole having a center line spaced in the diametrical direction from the center line of the center hole; and a clearance formed between the small diameter part and the center hole being larger than a clearance formed between the plunger and the guiding pipe, which is arranged around an outer periphery of the plunger.

3. The control valve for a variable displacement compressor as claimed in claim 1, wherein:

said plunger has an inserting hole, in which a middle part of the valve rod is fitly inserted;

a locking part for forcedly moving is provided at the upper side of the inserting hole of the valve rod; and a clearance formed between the valve rod and the inserting hole is made larger than a clearance formed between the plunger and the guiding pipe arranged around the outer periphery of the plunger.

4. The control valve for a variable displacement compressor as claimed in claim 2, wherein:

said plunger has an inserting hole, in which a middle part of the valve rod is fitly inserted;

a locking part for forcedly moving is provided at the upper side of the inserting hole of the valve rod; and a clearance formed between the valve rod and the inserting hole is made larger than a clearance formed between the plunger and the guiding pipe arranged around the outer periphery of the plunger.

5. The control valve for a variable displacement compressor as claimed in claim 3, wherein:

said locking part for forcedly moving is formed with an annular member which is externally fitted to the valve rod to be caulked and fixed.

6. The control valve for a variable displacement compressor as claimed in claim 4, wherein:

said locking part for forcedly moving is formed with an annular member which is externally fitted to the valve rod to be caulked and fixed.

7. The control valve for a variable displacement compressor as claimed in claim 3, wherein:

said valve rod is divided into an upper part and a lower part, where the upper part is from an upper end part contacting to the pressure sensitive response member to the upper side of the locking part for forcedly moving, and the lower part is the lower side of the upper part; and a lower end face of the upper part oppositely contacts to an upper end face of the lower part.

8. The control valve for a variable displacement compressor as claimed in claim 4, wherein:

said valve rod is divided into an upper part and a lower part, where the upper part is from an upper end part contacting to the pressure sensitive response member to the upper side of the locking part for forcedly moving, and the lower part is the lower side of the upper part; and a lower end face of the upper part oppositely contacts to an upper end face of the lower part.

9. The control valve for a variable displacement compressor as claimed in claim 5, wherein:

said valve rod is divided into an upper part and a lower part, where the upper part is from an upper end part contacting to the pressure sensitive response member to the upper side of the locking part for forcedly moving, and the lower part is the lower side of the upper part; and a lower end face of the upper part oppositely contacts to an upper end face of the lower part.

10. The control valve for a variable displacement compressor as claimed in claim 6, wherein:

said valve rod is divided into an upper part and a lower part, where the upper part is from an upper end part contacting to the pressure sensitive response member to the upper side of the locking part for forcedly moving, and the lower part is the lower side of the upper part; and a lower end face of the upper part oppositely contacts to an upper end face of the lower part.

11. The control valve for a variable displacement compressor as claimed in claim 1, wherein:

said valve rod is divided into an upper part and a lower part, where the upper part is from an upper end part contacting to the pressure sensitive response member to the upper side of the locking part for forcedly moving, and the lower part is the lower side of the upper part; and a lower end face of the upper part oppositely contacts to an upper end face of the lower part.

12. The control valve for a variable displacement compressor as claimed in claim 2, wherein:

said valve rod is divided into an upper part and a lower part, where the upper part is from an upper end part contacting to the pressure sensitive response member to the upper side of the locking part for forcedly moving, and the lower part is the lower side of the upper part; and a lower end face of the upper part oppositely contacts to an upper end face of the lower part.

13. The control valve for a variable displacement compressor as claimed in claim 1, wherein the center hole and the eccentric hole are longitudinally or axially coextensive.

14. The control valve for a variable displacement compressor as claimed in claim 2, wherein the center hole and the eccentric hole are longitudinally or axially coextensive.

* * * * *